United States Patent [19]

Kawai et al.

[11] Patent Number: 4,852,634

[45] Date of Patent: Aug. 1, 1989

[54] GAS VENTING ARRANGEMENT IN INJECTION MOLDING APPARATUS AND METHOD FOR VENTING GAS IN THE INJECTION MOLDING APPARATUS

[75] Inventors: Kazuaki Kawai; Hitoshi Ishida; Noriyoshi Yamauchi, all of Fuchu, Japan

[73] Assignee: Ryobi Ltd., Hiroshima, Japan

[21] Appl. No.: 128,185

[22] Filed: Dec. 3, 1987

[30] Foreign Application Priority Data

Oct. 12, 1987 [JP] Japan ..... 62-156616
Oct. 12, 1987 [JP] Japan ..... 62-156615[U]
Oct. 20, 1987 [JP] Japan ..... 62-265797[U]

[51] Int. Cl.[4] ..... B22D 17/00

[52] U.S. Cl. ..... 164/457; 164/113; 164/154; 164/305

[58] Field of Search ..... 164/305, 312, 410, 150, 164/154, 457, 4.1, 113

[56] References Cited

U.S. PATENT DOCUMENTS 4,431,047 2/1984 Takeshima et al. .
4,463,793 8/1984 Thurner ..... 164/155

FOREIGN PATENT DOCUMENTS 41-10612 6/1966 Japan .
56-14923 4/1981 Japan .
60-19806 6/1985 Japan .
61-17349 1/1986 Japan .
61-165262 7/1986 Japan .

*Primary Examiner*—Kuang Y. Lin
*Attorney, Agent, or Firm*—Oliff & Berridge

[57] ABSTRACT

Disclosed is a gas venting arrangement in an injection molding apparatus, and a method for venting gas out of the injection molding apparatus. The gas venting arrangement includes mold halves formed with a gas vent passage in fluid communication with a mold cavity and positioned downstream thereof, a gas vent control valve disposed at a downstream end portion of the vent passage, a detection member disposed at the vent passage for detecting injected material exceeding over the mold cavity, a valve driving mechanism connected to the gas vent control valve, and an electric control means connected between the detection member and the valve driving mechanism. The detection member generates a detection signal upon contact with the injected material and the valve driving mechanism is operated in response to the detection signal through the electric control means to operate the vent control valve.

8 Claims, 5 Drawing Sheets

GAS VENTING ARRANGEMENT IN INJECTION MOLDING APPARATUS AND METHOD FOR VENTING GAS IN THE INJECTION MOLDING APPARATUS

BACKGROUND OF THE INVENTION

The present invention relates to a gas venting arrangement in an injection molding apparatus, and to a method for venting gas in the injection molding apparatus.

In an injection molding method such as a diecasting method, a molded product often contains voids in its interior due to injection of a molten metal into a mold cavity in which gases are extant. The gases are mingled with the molten metal and remain intact.

According to a conventional gas venting arrangement and gas venting method in the injection molding apparatus, a gas vent passage extending from the mold cavity is formed in mold halves, and a valve is disposed at the gas vent passage. With the structure, if molten material is injected into the mold cavity, while the valve is left open, gas in the mold cavity is discharged out of the mold halves.

In such type of arrangement and method for gas vent, the valve is closed by the flow-mode of molten material having sufficient injection velocity. If the molten material is injected at low velocity, the valve is incapable of closing. Further, in the conventional arrangement, molten material passes through a bypass passage until the moving energy of the molten material closes the valve. However, if valve closing timing is not stabilized, molten material may be inadvertently discharged through the gas vent passage out of the metal molds, and insufficient gas venting results.

Furthermore, various injection modes should have to be considered. For example, during injection of the molten material into the mold cavity, a part of the molten material may be dispersed into the gas vent passage as small molten grains. Alternatively, after the mold cavity is completely filled with the molten material, surplus molten material is continuously or discontinuously advanced into the gas vent passage.

According to the conventional gas venting arrangement, molten material may be discharged through the valve toward atmosphere or may be adhered to the valve, since the mode of the molten material cannot be promptly detected by mere detection of inertia force or pressure of the molten material or by the employment of a heat sensor. Therefore, insufficient gas venting results due to adhesion of molten material to the valve. Moreover, in the conventional arrangement, an inner diameter of the gas vent passage must be small in size so as to restrain prompt passing of the molten material therethrough for avoiding leakage of the molten material. Therefore, the gas venting function is also restrained by the small diameter passage.

Japanese Utility Model Publication No. 60-19806 discloses a gas venting arrangement in an injecting molding apparatus in which a gas vent control valve is closed by hydraulic pressure in response to an operation of an injection cylinder for injection a molten material into a mold cavity. As is well known, since the injection cylinder is positioned upstream with respect to the mold cavity, and since the gas vent control valve is disposed downstream thereof, the above-described drawbacks may not be overcome by mere detection of the movement of the injection cylinder.

Japanese Patent Application Publication (kokai) No. 61-17349 discloses a sensor mechanism which detects molten material reaching to a gate portion of the mold halves. This detection leads to operation of a vacuum valve mechanism. However, the sensor mechanism is disposed at the gate portion which portion is positioned upstream of the mold cavity. Therefore, this structure cannot attain prompt closing of the gas vent valve in response to the various modes of the injection molten material.

Japanese Patent Publication No. 41-10612 discloses a flange portion integral with a rod of a casting sleeve. When casting of the melted material is performed, the plunger rod is moved to push the melted material toward a mold cavity. During the rod movement, the flange portion abuts a switch so that a gas vent control valve is moved to close the vent passage, and vacuum valve is closed. With the arrangement, the vent control valve is inadvertently moved to close the vent passage in the injection period into the mold cavity. Therefore, resultant casted product may contain voids therein due to insufficient gas discharge. Further, a timer is used to render the internal space of the casting sleeve sufficiently filled with the melted product prior to the movement of the plunger rod. Therefore, the resultant structure becomes much more complicated.

The same is true with respect to Japanese Utility Model Publication No. 56-14923 and Japanese Patent Application Publication (kokai) No. 61-165262. In the former publication, a sensor is disposed at an upstream side with respect to the mold cavity to operably move the gas vent control valve. And in the latter publication, a sensor is disposed in a mold cavity to detect the melted material in order to operate the gas vent control valve in response to the detection. Therefore, in both publications, insufficient gas venting may occur, to thereby provide void containing casted product.

U.S. Pat. No. 4,431,047 discloses a gasventing arrangement incorporated with a mold which belongs to the technical field relevant to that of the present invention. Further, co-pending U.S. patent application, commonly assigned, has been filed bearing Ser. No. 26,317 filed Mar. 16, 1987, now U.S. Pat. No. 4,722,385.

SUMMARY OF THE INVENTION

It is therefore, an object of the present invention to overcome the above-described drawbacks and disadvantages and to provide an improved arrangement and method for venting gas from a mold cavity in an injection molding apparatus.

Another object of this invention is to provide such arrangement and method in which gas in the mold cavity is completely discharged in a stabilized manner and void-free products are attainable.

Still another object of this invention is to provide such an arrangement and method in which a gas vent passage is promptly closed by a vent control valve in response to a detection of molten material at the gas vent passage.

Still another object of this invention is to provide such an arrangement and method available for low speed casting as well as high speed casting.

These and other objects of this invention will be attained by providing a gas venting arrangement in an injection molding apparatus which includes mold halves defining a mold cavity there-between. The gas venting arrangement comprises the mold halves formed with a gas vent passage in fluid communication with the mold cavity and positioned downstream thereof, a gas vent control valve, a detection member, a valve driving mechanism and an electric control means. The gas vent control valve is disposed at the downstream end portion of the gas vent passage. The detection member is disposed at the gas vent passage for generating a detection signal upon detecting the injected material directed toward the gas vent control valve. The valve driving mechanism is operably connected to the gas vent control valve for driving the gas vent control valve. The electric control means is connected between the detection member and the valve driving mechanism. The electric control means transmits the detection signal to the valve driving mechanism for closing the gas vent control valve when the detection member detects the injected material at the gas vent passage.

According to a method of this invention, molten material from the mold cavity is detected by the detection member and the detection member generates detection signal. The detection signal is transmitted to the electric control means. The electric control means supplies instruction signal to the valve driving mechanism for driving the gas vent control valve.

DETAILED DESCRIPTION OF THE PREFERRED EMBODIMENTS

Figure 1:
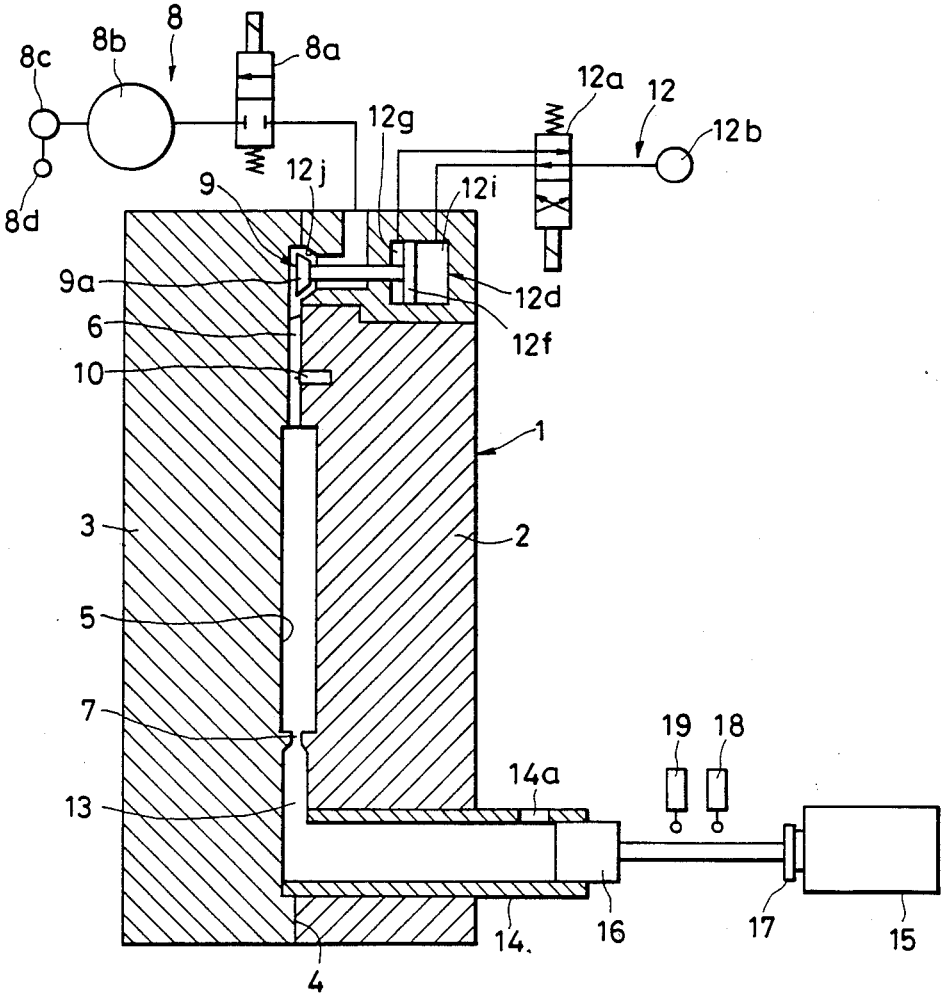
FIG. 1 is a cross-sectional view showing a gas venting arrangement in an injection molding apparatus according to a first embodiment of the present invention.

A first embodiment according to the present invention will be described with reference to FIGS. 1 and 2. A metal mold 1 includes a stationary mold half 2 and a movable mold half 3. Parting faces 4 of the mold halves 2 and 3 are formed with a mold cavity 5 and a gas vent passage 6 in fluid communication with the cavity 5. The gas vent passage 6 has relatively large inner diameter. A gate 7 is provided at an upstream side of the mold cavity 5, and the gas vent passage 6 is formed at a downstream side thereof. The distal end of the gas vent passage is open to the atmosphere. Alternatively, the distal end is connected to a vacuum sucking device 8 as shown for positively discharging gas in the mold cavity 5 toward the outside of the metal mold 1. The vacuum sucking device 8 includes an electromagnetic change-over valve 8*a*, a tank 8*b*, a vacuum pump 8*c* and a motor 8*d*.

At the downstream end portion of the gas vent passage 6, there is provided a tapered gas vent control valve 9 for selectively opening the gas vent passage 6 to thus allow gas to discharge therefrom. Further, a detection member 10 is disposed at the gas vent passage 6 and at the upstream side of the control valve 9. The detection member 10 detects the molten material such as electrically conductive molten metal. Details of the detection member 10 will be described later with reference to FIGS. 5, 7 and 8 as first, second and third embodiments of the detection member, respectively. When the molten material is brought into contact with the detection member 10, the detection member 10 detects the molten material and sends a detection signal to an electric control means (not shown), and the electric control means sends an instruction signal to a valve driving mechanism. The gas vent control valve 9 is moved in response to the operation of the valve driving mechanism.

Figure 2:
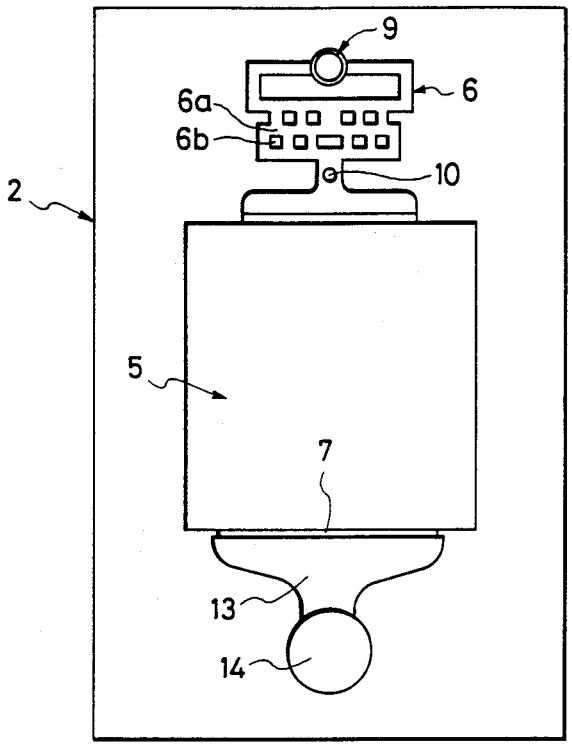
FIG. 2 is a front view of a stationary mold half in the first embodiment.
Figure 4:
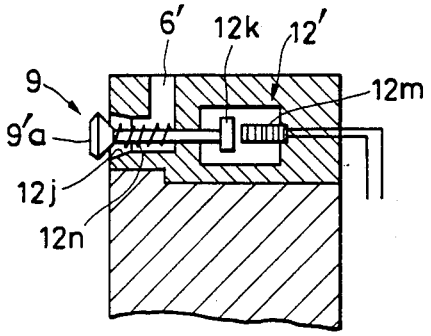
FIG. 4 is a cross-sectional view showing a valve driving mechanism modified relative to the first embodiment.

The valve driving mechanism 12 shown in FIG. 1 includes a valve driving cylinder 12*d*, a piston 12*f* integrally connected to a valve head 9*a* of the gas vent control valve 9 and slidable in the valve driving cylinder 12*d*, an electromagnetic change-over valve 12*a* and a compressor 12*b*. The piston 12*f* divides the driving cylinder 12*d* into a front chamber 12*g* and a rear chamber 12*i*. The change over valve 12*a* provides first and second positions. In the first position, pneumatic pressure is positively applied to the front chamber 12*g* by the pneumatic drive means 12*b* to move the piston 12*f* toward the rear chamber 12*i*, so that the valve 9 closes a tapered valve seat 12*j*. In the second position of the changeover valve 12*a* (FIG. 1 shows the second position of the change-over valve 12*a*), pneumatic pressure is positively applied to the rear chamber 12*i* to urge the piston 12*f* toward the front chamber 12*g*, so that the valve head 9*a* is moved away from the valve seat 12*j*, to thereby allow gas to pass therethrough. Alternatively, according to a modified embodiment shown in FIG. 4, the valve driving mechanism 12' includes a magnetic member 12*k* integrally connected to the valve head 9*a'*, an electromagnetic member 12*m* and a coil spring 12*n*. In the modified embodiment, excitation of the electromagnet 12*m* attracts the magnetic member 12*k* against the biasing force of the coil spring 12*n* for seating the valve head 9*a'* onto the valve seat 12*j*. And deenergization of the electromagnet 12*m* moves the valve head 9*a'* away from the valve seat 12*j* because of the biasing force of the spring 12*n* to thereby open the valve 9. In FIGS. 1 and 4, when the valve head 9*a* or 9*a'* is moved leftwardly, the valve head is spaced away form the valve seat 12*j*, and when the valve head is moved rightwardly, the valve head is brought into seating contact with the valve seat 12*j*.

Figure 3:
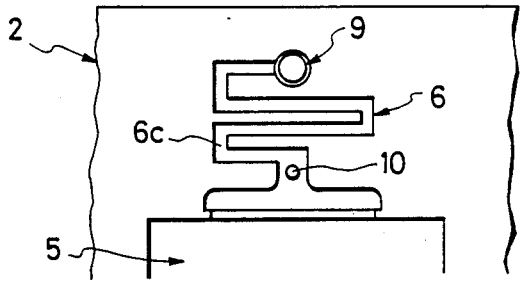
FIG. 3 is a front view showing a modified arrangement in a stationary mold half.

In the present invention, if molten material were to reach the gas vent control valve 9 and be discharged therefrom prior to complete closing of the gas vent control valve 9 in response to the detection of the molten material by the detection member 10, it would be impossible to conduct subsequent injection molding. Therefore, it is necessary to retard the molten material in reaching the gas vent control valve 9 so to that the vent control valve 9 is closed prior to the molten material reaching the valve 9. Therefore, after detection of the molten material by the detection member 10, sufficient time period must be provided by delaying the molten material in reaching the valve 9. For this, in the first embodiment, the gas vent passage 6 is in the form of net pattern 6a having a plurality of obstructing protrusions 6b as shown in FIG. 2. Alternatively, the gas vent passage 6 is in the form of meandering pattern 6c as shown in FIG. 3.

Figure 5:
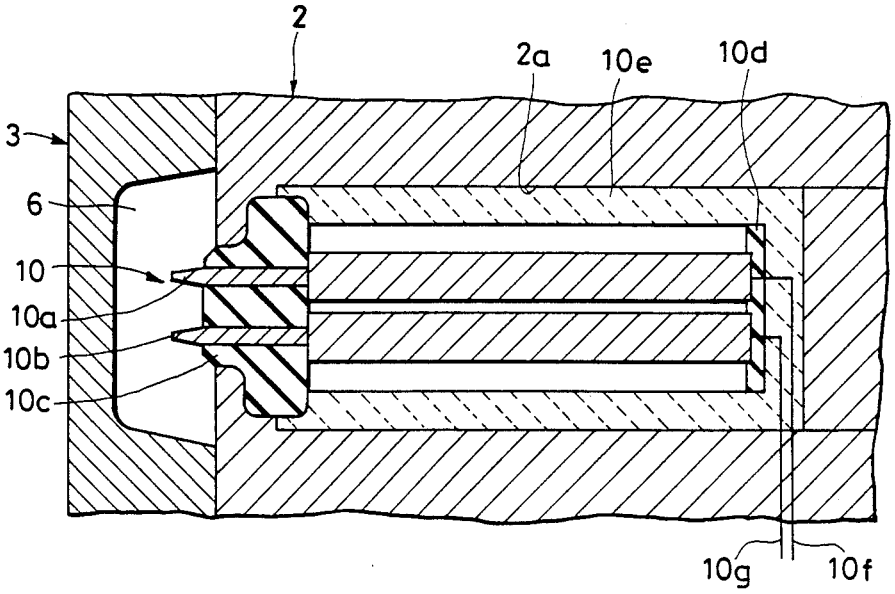
FIG. 5 is a cross-sectional view showing a detection member used in the first embodiment of this invention.

Turning to the detection member shown in FIG. 5, a pair of pins 10a and 10b formed of electrically conductive material are juxtaposed with each other by a proper spacing, and are held by a non-electrically conductive holder 10e through insulating members 10c and 10d. The insulating members 10c and 10d are formed of heat resistant and corrosion resistant material such as ceramics, since the insulation member is in contact with molten material having high temperature. The holder 10e is fitted in a recessed portion 2a of the stationary mold half 2. Tip end portions of the pins 10a and 10b are exposed to the gas vent passage 6 and the tip end portions are directed substantially perpendicular to a flowing direction of the molten material. The other end portions of the pins are connected with lead wires 10f and 10g which are connected to the electric control means.

Turning back to FIG. 1, the stationary mold half 2 is fixed with a casting sleeve 14 formed with a casting port 14a. The casting sleeve 14 communicates with a melt runner 13 separated from the mold cavity 5 by the gate 7. An injection cylinder 15 is provided with an injection plunger 16 extending from and retracting into the cylinder 15. The plunger 16 is integrally provided with a striker 17 abuttable against a limit switch 18 and a high-speed limit switch 19 during extension strokes of the plunger 16. The limit switch 18 is electrically connected to the electromagnetic change-over valve 8a, and the limit switch 19 is electrically connected to the injection cylinder 15. The molten material supplied into the casting sleeve 14 through the casting port 14a is introduced into the mold cavity 5 through the runner 13 and the gate 7 by the extension of the plunger 16. After the plunger 16 extends to close the casting port 14a, the striker 17 abuts against the limit switch 18, so that the electromagnetic change-over valve 8a is operated. As a result, gas in the mold cavity and the casting sleeve 14 is aspirated by the pump 8c and is discharged therefrom through the valve 9. However, even if the distal end of the gas vent passage 6 is not connected to the vacuum sucking device 8 but is connected to the atmosphere, gas in the mold cavity 5 and the casting sleeve 14 can be discharged therefrom because of the large inner diameter of the gas vent passage 6. In other words, in the present invention, the gas vent passage 6 can provide large diameter because of complete prevention of the molten material from leaking out of the control valve 9. The passage 6 having large inner diameter allows gas to easily pass therethrough. When the striker 17 abuts against the limit switch 19, the limit switch 19 generates an instruction signal to a driver unit (not shown) to operate the plunger 16 at high extension speed, so that high speed casting is attainable.

In operation, while the valve head 9a of the gas vent control valve 9 is spaced away from the valve seat 12j, the molten material is poured into the casting sleeve 14 through the casting port 14a and the casting cylinder 15 moves the plunger 16 toward the sleeve 14 and the plunger 16 closes the casting hole 14a. Thereafter, electromagnetic change-over valve 8a is operated upon abutment of the striker 17 to the limit switch 18. As a result, vacuum pump 8c is connected to the distal end of the gas vent passage 6 for discharging gas in the cavity 5 and the sleeve 14 from the metal mold 1. In this sequence, opening of the valve 9 is maintained.

When the plunger 16 further extends to completely fill the molten material into the mold cavity 5, the molten material may flow into the gas vent passage 6 and into contact with the detection member 10. Upon contact, a closed electrical curcuit is provided, since the molten material is an electrically conductive material, and the member 10 issues a detection signal. Thus, the electromagnetic change-over valve 12a is operated or is moved to a first position by the detection signal through the electric control means (not shown in FIG. 1). By the change-over operation of the valve 12a, the front chamber 12g of the valve driving cylinder 12d is connected to the compressor 12b, so that pneumatic pressure is applied to the front chamber 12g. As a result, the piston 12f is urged toward the rear chamber 12i, and the valve head 9a is seated onto the valve seat 12j for closing the valve 9. Therefore, leakage of the molten material from the metal mold 1 can be prevented. In this case, since the tapered valve 9 is seated on the tapered valve seat 12j, close contact therebetween is attainable to thus further ensure prevention of melted material from leakage. After the injection molding, the movable mold half 3 is separated from the stationary mold half 2, for removing the molded product. In this product removal, flashes can be also removed from the gas vent passage together with the casted product. Upon flash removal, the electric control means is operated to operate the electro-magnetic change-over valve 12a into the second position shown in FIG. 1. As a result, pneumatic pressure is applied to the rear chamber 12i to move the piston 12f toward the front chamber 12g, to thereby move the valve head 9a away from the valve seat 12j. This is the reset position of the gas vent control valve 9.

In the modified embodiment shown in FIG. 4, when the detection member 10 detects the molten material, the electric control means is operated to supply electrical current into the electro-magnetic member 12m for its excitation. Therefore, the magnetic member 12k is attracted to move the valve head 9a' toward the valve seat 12j for closing the valve against the biasing force of the coil spring 12n. Further, when the molded product is removed and the flash is concurrently separated from the detection member 10, the electric control means is operated to prevent electrical current from being supplied into the electro-magnetic member 12m. Therefore, the valve head 9a' is moved away from the valve seat 12j by the biasing force of the coil spring 12n. As a result, the valve 9' is opened to allow gas to pass therethrough.

In view of the above, according to the gas venting arrangement and gas venting method in the injection molding apparatus in the present invention, gas is discharged and the gas vent control valve is closed with proper timing. Therefore, sufficient gas discharge is attainable yet the molten material is presented from being leaked from the control valve and without formation of voids in the molded product. In other words, in the present invention, the gas vent passge is fully open as long as possible to allow gas discharge for avoiding formation of voids in the molded product, yet the melted material is prevented from leakage because of prompt valve closure upon detection of the melted material by the detection member 10. Moreover, inadvertent melted material leakage is further avoidable because of simple mechanical arrangement such as an additional exhaust passage 6. The electrical detection of the molten material and electrical actuation of the valve drive mechanism provide stabilized and accurate opening and closing of the gas vent control valve. Therefore, the present invention is available for high speed casting as well as low speed csating eliminating the formation of voids in the molded or casted product.

A gas venting arrangement according to a second embodiment will be described with reference to FIG. 6, wherein like parts and components are designated by the same reference numerals and characters as those shown in the first embodiment. In the second embodiment, an electronic circuit 11 is provided between the detection member 10 and the electromagnetic valve 12*a* of the valve driving mechanism 12'.

The electronic circuit 11 is promptly operated under detection of the molten material by the detection member 10. The electronic circuit 11 comprises a filtering circuit 11*a* and a flip-flop circuit 11*b* which detects leading edge of the detection signal sent from the detection member and produces an output drive signal to be sent to an electromagnetic valve 12*a* of the valve driving mechanism 12'. The flip-flop circuit 11*b* is also connected to an electrical control unit U for receiving a signal 11*c* and a signal 11*d* therefrom. The signal 11*c* is generated by a limit switch and is indicative of the initial start-up of casting the molten material into the casting sleeve 14, and the signal 11*d* is a reset signal and is indicative of the removal of flash from the detection member 10 for change-over operation of the electromagnetic valve 12*a*. The signal 11*c* is generated upon actuation of the limit switch 18. The flip-flop circuit 11*b* maintains melted material detection state even by instantaneous detection thereof by the detection member 10, to thus ensure operation of the electromagnetic valve 12*a*.

The valve driving mechanism 12' is adapted to operate a gas vent control valve 9, and is operated upon receiving the output drive signal from the electronic circuit 11. The valve driving mechanism 12' includes the electromagnetic vlave 12*a*, a compressor 12*b*, a valve driving cylinder 12*d'*, a piston 12*f'*, similar to the first embodiment. Further, in the second embodiment, the valve driving mechanism also includes a pressure control valve 12*c* and an associated pressure line 12*e*. The piston 12*f'* defines an intermediate chamber 12*h* in addition to front and rear chambers 12*g'* and 12*i'*. The intermediate chamber 12*i* is in fluid communication with the pressure control valve 12*e*. When the compressor 12*b* is connected to the intermediate chamber 12*h* through the pressure control valve 12*e*, pneumatic pressure in the intermediate chamber 12*h* prevents the gas vent control valve 9 from being moved toward a valve seat 12*j*. In other words, the intermediate chamber 12*h* is adapted to prevent the valve 9 from its closure at early stages, and the pressure control valve 12*e* serves to supply a controlled amount of pressure into the chamber 12*h* for controlling repulsive forces against closing of the valve 9.

The flip-flop circuit 11*b* is connected to the electromagnetic valve 12*a* for change-over operation thereof, so that pneumatic pressure from the compressor 12*b* can be applied to the front chamber 12*g'* simultaneous with the discharge of pneumatic pressure from the intermediate chamber 12*h*. This change-over position of the valve 12*a* is referred to as a first position. If the valve 12*a* is shifted to allow fluid communication between the compressor 12*b* and the intermediate chamber 12*h*, this valve position is referred to as a second position (shown in FIG. 6).

Figure 6:
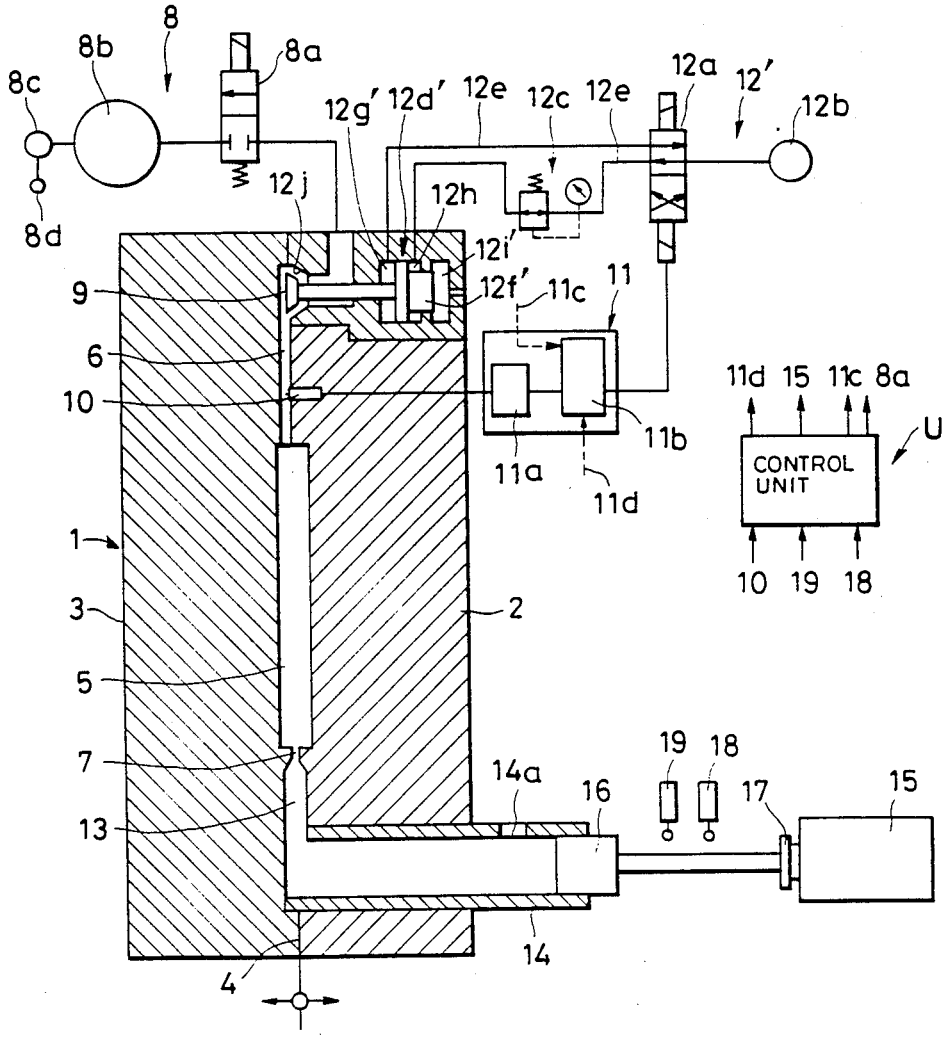
FIG. 6 is a cross-sectional view showing a gas venting arrangement according to a second embodiment of this invention used in an injection molding apparatus.

In operation, FIG. 6 shows the state prior to casting of molten material into the casting sleeve 14 through the casting port 14*a*. Starting from this state, the molten material is casted into the sleeve 14 and the plunger moves frontwardly to urge the molten material toward the mold cavity 5. In this instance, the electrical control unit U receives the signal which indicates initiation of the casting, and the signal is output into the electronic circuit 11 as the output signal 11*c*. This signal 11*c* serves to bias or provide a stand-by state of the flip-flop circuit 11*b* for its prompt operation required in the subsequent output operation to the electro-magnetic valve 12*a*. This start signal can also be issued during injection of the molten material into the mold cavity. The striker 17 abuts the limit switch 18 and then abuts the high speed limit switch 19 in the manner the same as that of the first embodiment. If part of the injected molded material is scattered through the gas vent passage 6 and makes contact with the detection member 10 during material injection process into the mold cavity 5, or if the molten material is continuously or discontinuously advanced through the passage 6 and is brought into contact with the detection member 10 after complete filling of the material into the cavity 5, the electronic circuit 11 is rapidly operated, so that the electromagnetic valve 12a is moved from a second position to a first position to thereby close the vent control valve 9. In the first position, pneumatic pressure from the compressor 12*b* is supplied to the front chamber 12*g'*, and pneumatic pressure confined in the intermediate chamber 12*h* is discharged therefrom. Therefore, the vent control valve 9 is seated onto the valve seat 12*j*, to thus complete valve closure.

After injection molding, the movable mold half 3 is separated from the stationary mold half 2, and flash is removed simultaneously with the removal of the molded product. Upon this flash removal, the control unit U receives the signal and outputs a reset signal 11d to the electronic circuit 11. Upon receipt of the reset signal, the electromagnetic valve 12*a* is shifted to the second position in which the pneumatic pressure is applied to the intermediate chamber 12*h*, and pressure in the front chamber 12*g'* is discharged therefrom. As a result, the gas vent control valve 9 is opened for providing stand-by position for the next injection molding operation.

Figure 7:
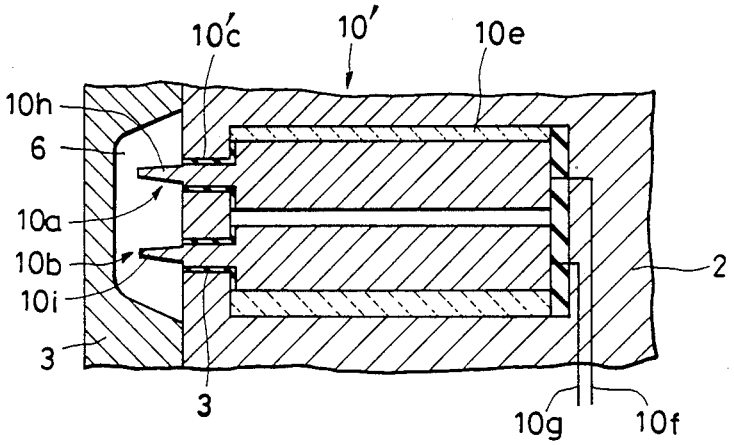
FIG. 7 is a cross-sectional view showing a second embodiment of a detection member according to this invention.
Figure 8:
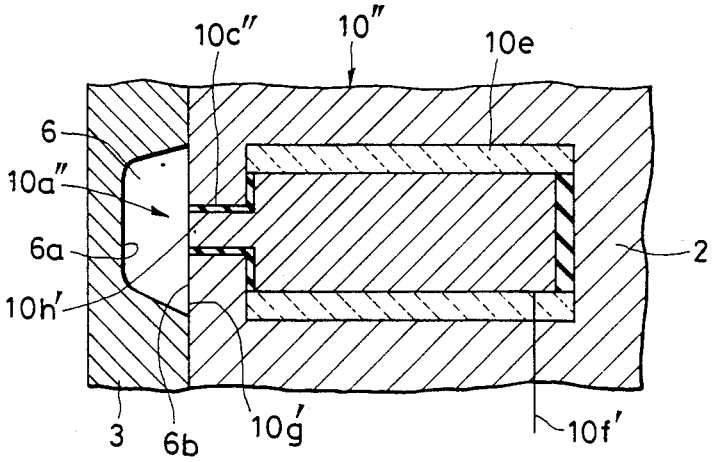
FIG. 8 is a cross-sectional view showing a third embodiment of a detection member according to a third embodiment of this invention.

FIGS. 7 and 8 are other embodiments showing detection members 10' and 10''. In the detection member 10 shown in FIG. 5, ceramic is used as a material of the insulating member 10*c*. If aluminum is used as molten material, the ceramic insulator may be broken by thermal shock due to direct contact with the molten aluminum, to thereby degrade durability. Upon breakage of the insulating member, a closed electrical circuit is always provided at the detection member, so that the gas venting arrangement becomes inoperable. In the modified embodiments shown in FIGS. 7 and 8, a pin or pins are entirely covered with insulating material except the tip end portion to be exposed to the molten material, and the thus insulated pin is fitted with metal mold by shrinkage-fitting. Therefore, the pin(s) is electrically insulated from the metal mold.

In FIG. 7, two electrically conductive pins 10*a* and 10*b* are formed with insulation 10*c'* except the tip end portions 10*h* and 10*i*. The bare end portions 10*h* and 10*i* project into and are exposed to the gas vent passage 6. Similar to the embodiment shown in FIG. 5, the two pins are spaced away from each other and extend in a direction substantially perpendicular to the flowing direction of the molten material. Further, the pins are fixedly secured to the stationary mold half 2 by shrinkage-fitting in order to minimize the gap between the insulator 10c' and the mold half 2 and to prevent the insulator 10c' from peeling from the pins. These pins 10a and 10b are assembled to the mold half 2 through a non-electrically conductive holder 10e. Alternatively, annular insulation space is provided between the pins and the mold half 2. The insulator 10c' can be formed by spraying ceramic material such as $Al_2O_3$, SiC, BN, $Si_3N_4$, etc. Alternatively, such ceramic material is formed by CVD (chemical vapor deposition) or by PVD (physical vapor deposition). In another way, these pins excluding the tip end portions are subjected to oxidation treatment to provide oxidized films over the periphery.

According to still another embodiment shown in FIG. 8, only a single pin 10a'' is provided. A planar tip end of the pin 10a'' is flush with the surface of the mold half 2, and insulator 10c'' is formed over the pin 10a'' except the planar end portion 10h'. The pin 10a'' is assembled to the mold half 2 by shrinkage fitting. An electrically closed circuit is provided between the planar end poriton 10h' and an inner peripheral surfaces 6a and 6b of the gas vent passage 6. Of course, the connection line 10g' is electrically connected to one of the peripheral surfaces 6a and 6b of the passage 6.

With the structures shown in FIGS. 7 and 8, only a reduced area of the insulator is exposed to the molten material, and the bare electrically conductive pin(s) is subtantially exposed thereto. Therefore, the insulator is not subjected to any thermal damage, to thereby enhance reliability and durability of the detection member.

While the invention has been described in detail and with reference to specific embodiments thereof, it will apparent for those skilled in the art that various changes and modifications can be made therein without departing from the spirit and scope of the invention.

What is claimed is:

1. A gas venting arrangement in a high speed injection molding apparatus which includes a casting sleeve and mold halves defining a mold cavity therebetween, an injected molten metal which is electrically conductive being fed through said casting sleeve and molded within said mold cavity, said gas venting arrangement comprising;

a gas vent passage formed in said mold halves, said gas vent passage in fluid communication with said mold cavity and positioned downstream thereto;

a gas vent control valve disposed at a downstream end portion of said gas vent passage;

a detection member disposed in said gas vent passage, the detection member comprising a means for detecting said injected molten metal in said gas vent passage and generating a detection signal indicative thereof;

a valve driving mechanism operably connected to said gas vent control valve for selectively driving said gas vent control valve to a first position in which said gas vent control valve is closed and a second position in which said gas vent control valve is open, said valve driving mechanism comprising an electromagnetic change-over valve;

a pneumatic piston/cylinder drive means connected to said gas vent control valve and operable in response to said change-over operation of said electromagnetic valve for moving said gas vent control valve;

a vacuum sucking device connected to said gas vent passage and positioned downstream of said gas vent control valve for positively discharging gas from said mold cavity during injection of said molten metal;

a control means having an electronic circuit means connected between said detection member and said electromagnetic change-over valve, said electromagnetic change-over valve providing change-over operation for selectively actuating said gas vent control valve to said first position in response to said detection signal, said electronic circuit means comprising a flip-flop circuit which provides instantaneous operation of said electromagnetic change-over valve upon detection of a leading edge of a detection signal instantaneously generated by the detection of injected molten metal by said detection member.

2. The gas venting arrangement as defined in claim 1, further comprising a control unit generating a second detection signal indicative of removal of a melt flash from said gas vent passage, said electromagnetic change-over valve actuating said gas vent control valve being moved into said second position in response to said second detection signal.

3. The gas vent arrangement as defined in claim 1, wherein said detection member comprises at least one electrically conductive pin having a tip end portion exposed to said gas vent passage, and an insulation layer formed over an entire surface of said pin except said tip end portion, said pin being assembled to one of said mold halves, and said pin being insulated for said stationary mold by said insulation layer.

4. The gas vent arrangement as defined in claim 3, wherein said pin formed with said insulation layer is fixedly assembled to said stationary mold by shrinkage-fitting.

5. The gas arrangement as defined in claim 2, further comprising a limit switch which generates a third signal indicative of initial casting of said injected material into said casting sleeve, thereby providing a stand-by state of said flip-flop circuit.

6. A method for venting gas in an injection molding apparatus which includes a casting sleeve and mold halves defining a mold cavity therebetween, an injected material being fed through said casting sleeve and molded within said mold cavity, said gas venting method comprising the steps of:

detecting said injected material by a detection member provided in a gas vent passage downstream of said mold cavity;

sending to a flip-flop circuit of an electric control means a first detection signal indicative of detection of said injected material by said detection member;

outputting an instruction signal from said flip-flop circuit of said electric control means to a valve driving mechanism in response to said first detection signal;

operating said valve driving mechanism in response to said instruction signal to close a gas vent control valve provided in said gas vent passage.

7. The method as defined in claim 6, further comprising the steps of generating a second detection signal indicative of removal of a melt flash from said gas vent passage, and actuating said valve driving mechanism in response to said second detection signal to open said gas vent control valve.

8. The method as defined in claim 7, further comprising the steps of generating a third detection signal indicative of detecting an initial start up of injection of said injected material into said casting sleeve, said third detection signal actuating a stand-by state of said electric control means.

* * * * *